US005405114A

United States Patent [19]

Dias

[11] Patent Number: 5,405,114

[45] Date of Patent: Apr. 11, 1995

[54] MODULAR COMPONENT ATTACHING SYSTEM

[75] Inventor: Gary R. Dias, Folsom, Calif.

[73] Assignee: California Prison Industry Authority, Folsom, Calif.

[21] Appl. No.: 187,403

[22] Filed: Jan. 25, 1994

[51] Int. Cl.[6] ..... E04G 3/08

[52] U.S. Cl. ..... 248/250; 52/36.6; 108/108; 211/187

[58] Field of Search ..... 248/221.3, 220.2, 222.1, 248/222.2, 227, 231.9, 243, 244, 235, 250, 241; 52/36.5, 36.6; 211/187; 108/108

[56] References Cited

U.S. PATENT DOCUMENTS

| | | | |
|---|---|---|---|
| 3,517,467 | 6/1970 | Propst et al. . | |
| 3,713,257 | 1/1973 | Beavers . | |
| 3,807,102 | 4/1974 | Albinson et al. . | |
| 4,198,913 | 4/1980 | Haworth et al. | 108/108 |
| 4,205,815 | 6/1980 | Sauer et al. | 248/243 |
| 4,601,137 | 7/1986 | Bates . | |
| 4,660,477 | 4/1987 | Kortering et al. | 108/108 |
| 4,669,692 | 6/1987 | Mastrodicasa | 248/235 X |
| 4,731,960 | 3/1988 | Sease . | |
| 4,775,125 | 10/1988 | Pfeifer | 248/222.1 |
| 4,962,805 | 10/1990 | Allen . | |
| 4,993,205 | 2/1991 | Dull et al. . | |
| 4,996,811 | 3/1991 | Dull et al. . | |
| 5,022,621 | 6/1991 | Quest | 248/225.2 |
| 5,346,077 | 9/1994 | Randall | 248/243 X |

FOREIGN PATENT DOCUMENTS 1759497 2/1979 Germany .

OTHER PUBLICATIONS

Haworth Installation Procedures, 1982, Haworth, Inc.
System XXI Installation Instructions, Undated.

*Primary Examiner*—Ramon O. Ramirez
*Attorney, Agent, or Firm*—John P. O'Banion

[57] ABSTRACT

An improved attachment system for mounting a furniture component, such as a work surface member, on the slotted vertical rails of a wall panel. The component connection system is comprised of a hook carrying component support adapted to be secured to a slotted vertical rail of a wall panel and releasably engageable with a component catch-track mechanism. The component support contains a latch-rail for securing a component such as a work surface by cooperating with the catch-track mechanism of the work surface. The component catch-track mechanism, when mounted on the component support, automatically engages the component support latch-rail member to fixedly align, draw together and connect both the component support and component catch-track mechanism. The improved attachment system method also eliminates the movement or disturbance of portable wall panel structures during the installation process.

17 Claims, 6 Drawing Sheets

MODULAR COMPONENT ATTACHING SYSTEM

BACKGROUND OF THE INVENTION

1. Field of the Invention

This invention pertains generally to attachment of modular furniture components to wall panels, and more particularly to an attachment system wherein a component can be detachably coupled to a support bracket which is in turn detachably coupled to bracket support rails of a wall panel.

2. Description of the Background Art

Wall structures formed from a plurality of prefabricated interconnected and portable panels are used extensively in commercial and industrial buildings for dividing interior regions into smaller work regions. A variety of components are available for attachment to the wall panels so that the work region can be fully equipped for its intended use. These components, such as work surfaces or desk tops, file cabinets, shelves, book cases and the like, are usually secured to a support bracket which is in turn secured to the wall structure. The support brackets typically include a plurality of vertically spaced, rearwardly extending and downwardly projecting hooks which mate with a plurality of vertically spaced slots in vertical bracket support rails provided at each end of the wall panels used in the wall structure.

The components are typically attached to the support brackets by means of screws or the like which extend through the bracket and into the underside of the component. Alternatively, various connection systems are available for detachably coupling the component to the support bracket, so that components can be more easily installed and removed. Those systems, however, typically require the installer to push the component being installed toward the wall panel in order to provide for proper engagement with the support bracket. When the components are attached in this manner, the wall panel usually moves or is otherwise shifted in position as a result of the amount of force required to install the component. This makes it difficult to connect the component and often requires realignment of the wall panels during or after installation.

Therefore, there is a need for a component attachment system which provides for convenient attachment and removal of components, and which provides for such attachment and removal without a resultant shifting in position of the wall panel. The present invention satisfies that need, as well as others, and overcomes the deficiencies found in prior attachment systems.

SUMMARY OF THE INVENTION

The present invention generally pertains to an apparatus for attaching a modular furniture component to wall panel wherein the component can be installed or removed from the wall panel by pulling toward the installer with minimal force, rather than pushing toward the wall panel, and without disturbing the location of the wall panel during the installation process.

By way of example, and not of limitation, the present invention comprises a support bracket which is configured for attachment to a vertical hang-on bracket support rail in a wall panel; a latch-rail member attached to the support bracket; and a mating catch-track member which is attached to the underside of the component and which can be detachably coupled to the latch-rail member.

The support bracket includes a plurality of rearwardly extending and downwardly projecting vertically aligned hooks for mating with corresponding slots in the hang-on bracket support rail. The support bracket also includes an enlarged top hook which not only provides increased strength load bearing capability, but also reduces the possible accidental disconnection of the support bracket from the wall panel by permitting such disconnection of the support bracket only when the bracket has the bottom edge thereof swingably moved outwardly a substantial distance away from the wall panel hang-on bracket support rail.

Attached to the support bracket and aligned longitudinally therewith, is an elongated latch-rail member having finger-like tabs projecting from its proximal end. A corresponding elongated catch-track member is provided for attachment to the underside of a component. The catch-track includes a channel between each end for receiving the latch-rail, and utilizes a compression spring to force the catch-track and latch-rail to draw together and connect the component with the support bracket. The component is installed by the support bracket by placing the distal end of the catch-track over the distal end of the latch-rail at a slight vertical angle, and then lowering the component into a horizontal position while pulling forward. When the latch-rail is aligned with the catch-track, the component is released and is drawn rearward toward under the force of the spring. At that point, the finger-like tabs on the track engage a locking plate on the rail to prevent vertical movement of the component. Lateral movement is also prevented since the latch-rail will be positioned within the channel in the catch-track. The component can then be removed by pulling forward and reversing the installation procedure.

The present invention provides for secure automatic latching of the component to the support bracket. Further, the invention allows an installer to apply forces away from the panel structure (toward the installer) during installation, thereby improving the installation process. The installer can hold the face of the wall structure as he or she pulls the component forward while coupling the latch-rail and catch-track. In this manner, the installation process will not cause wall panel movement or otherwise disturb the positioning of the panel structure.

Accordingly, it is an object of the present invention to provide an improved attachment system for modular furniture components which are supported by a wall structure.

Another object of the invention is to provide a component attaching system which utilizes a hook carrying component support which contains an enlarged top hook to reduce possible accidental disconnection of the support bracket from the wall structure.

Another object of the invention to provide a component attaching system which utilizes a latch-rail member which can be detachably coupled to a component mounted catch-track mechanism.

Another object of the invention is to provide a component attaching system having substantial strength and durability.

Another object of the invention is to provide a component attaching system having a relatively inexpensive and simple to manufacture automatic mechanism.

Another object of the invention is to provide a component attaching system which can automatically align, draw together and fixedly connect the support brackets and component member without the use of tools.

Another object of the invention is to reduce labor costs associated with installation of component members to support brackets.

Another object of the invention is to provide a component attaching system having a catch-track member with a compression spring which tensions the catch-track member and latch-rail member, and lockably secures the component to the support brackets.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 5. It will be appreciated that the apparatus may vary as to configuration and as to details of the parts without departing from the basic concepts as disclosed herein.

Figure 1:
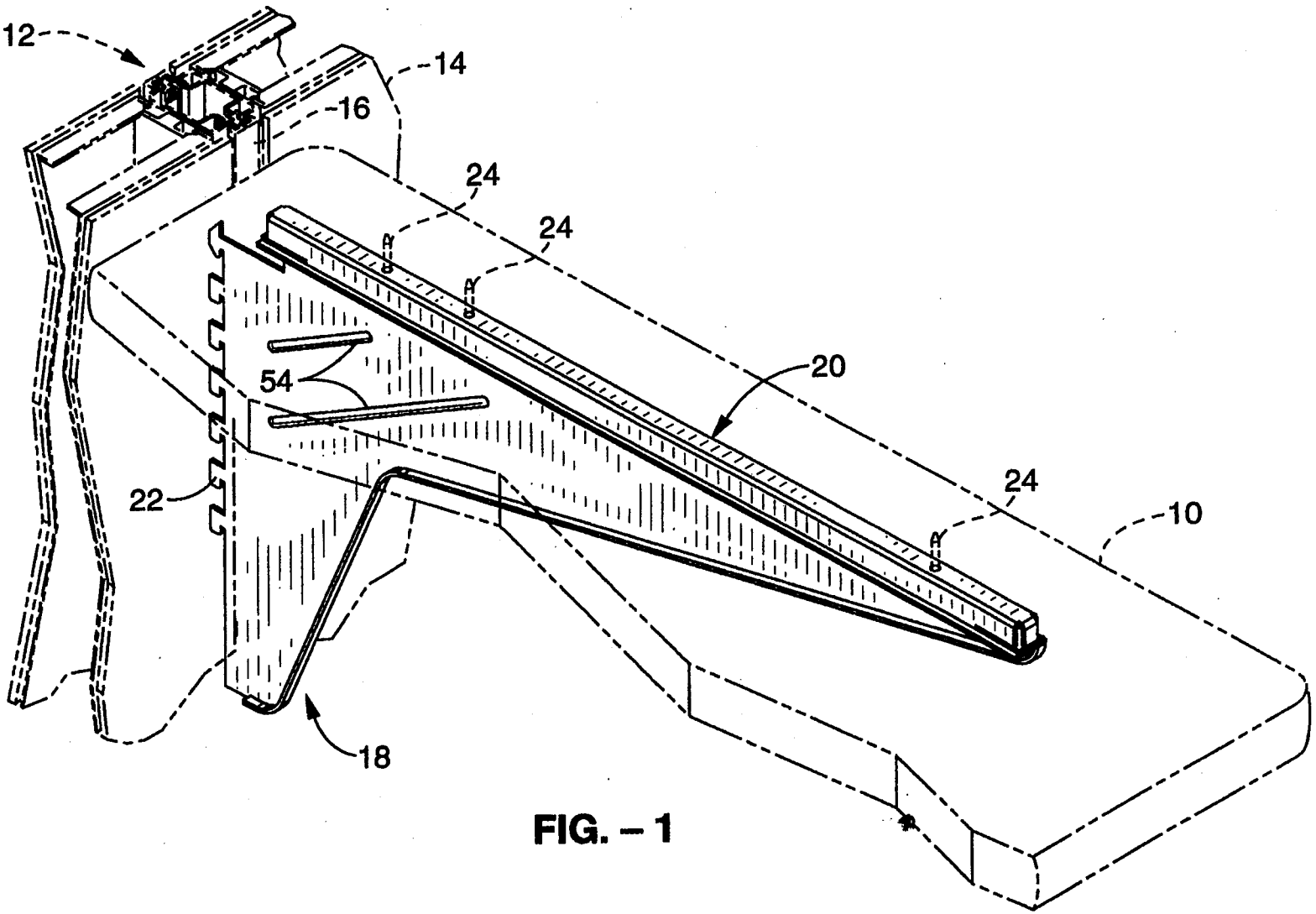
FIG. 1 is a perspective view of the apparatus of the present invention, shown attached to a work surface depicted in phantom and a wall structure depicted in phantom.

Referring to FIG. 1, a component attachment system in accordance with the present invention is shown for attaching a modular furniture component to a modular prefabricated wall structure. Here, a portion of a work surface component 10 is shown in phantom coupled to a wall structure 12 which is also shown in phantom. Wall structure 12 typically comprises one or more wall panels 14 which are joined at their ends. A vertical hang-on bracket support rail 16 is provided in the wall structure at the junction of the wall panels, and has a plurality of vertically oriented slots (not shown) located along the rail. Those skilled in the art will appreciate that hang-on bracket support rails of a similar configuration could be mounted to a building wall or the like and, therefore, the present invention is not limited in use to only modular prefabricated wall structures as shown.

The invention includes a component support subassembly 18 which is coupled to a catch-track subassembly 20. The component support subassembly 18 is coupled to hang-on bracket support rail 16 using a plurality of hooks 22, and the catch-track assembly 20 is coupled to the component 10 using a plurality of fasteners such as screws 24 or the like.

Figure 2A:
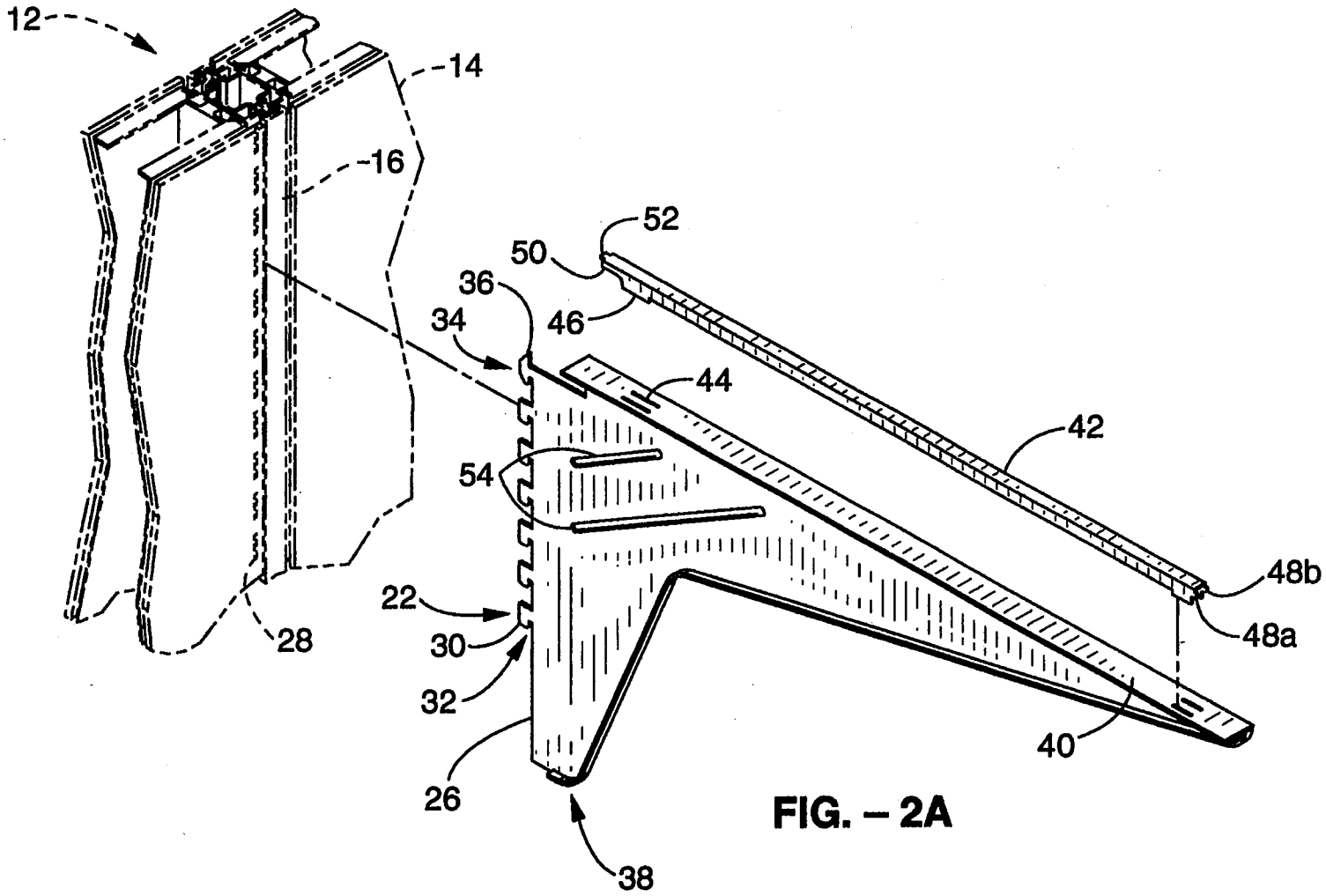
FIG. 2A is an exploded view of the component support subassembly of the present invention, and a wall structure depicted in phantom.
Figure 3:
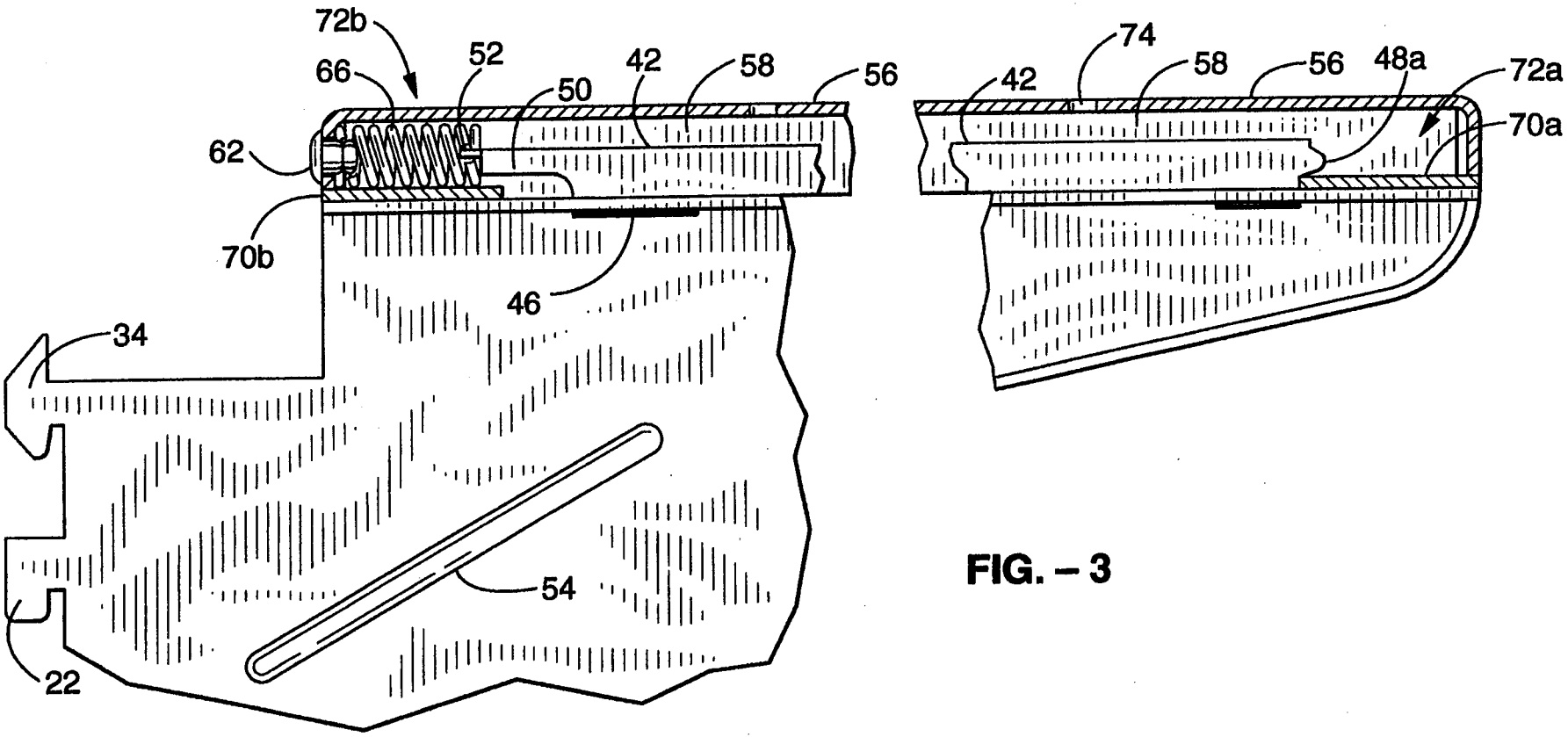
FIG. 3 is a side elevation showing the component support subassembly of FIG. 2A coupled to the catch-track subassembly of FIG. 2B.

Referring also FIG. 2A and FIG. 3, component support subassembly 18 generally comprises a support bracket 26 having a plurality of rearward extending hooks 22 vertically spaced along its distal end. Support bracket 26 is of a conventional, substantially L-shaped cantilever design as shown. Hooks 22 are of a conventional configuration for insertion into slots 28 found in hang-on bracket support rail 16. Each of the hooks 22 includes a downward projecting tab 30 and a receptacle 32 disposed between each tab 30 and the distal edge of support bracket 26. When hooks 22 are inserted into slots 28 and support bracket 26 is lowered, tabs 30 engage the inside surface of hang-on bracket support rail 16 and the upper edges of slots 28 fit within receptacles 32. In this manner, support bracket 26 is secured to hang-on bracket support rail 16. Note, however, that by lifting support bracket 26 in a vertical direction it can be removed from hang-on bracket support rail 16. This could present a safety hazard if the component supported by the bracket is accidentally lifted. Therefore, a safety hook 34 is provided at the uppermost position. Safety hook 34 not only includes a downward projecting tab 30, but also an upward projecting tab 36. Safety hook 34 reduces the possibility of accidental disconnection of the support bracket 26 from hang-on bracket support rail 16 by permitting such disconnection only when the bottom end 38 of support bracket 26 is swingably moved outwardly a substantial distance away from hang-on bracket support rail 16. It can be seen, therefore, that support bracket 26 must be inserted and removed at an angle. During installation, tab 36 is inserted first and support bracket 26 is lowered into place with a clockwise motion. During removal, support bracket 26 is raised with a counter-clockwise motion and hooks 22 are removed from slots 28 before removal of tab 36.

Located longitudinally along the upper edge of support bracket 26, and extending from the proximal end to a point near the distal end of support bracket 26, is a generally planar platform 40 to which an elongated latch-rail 42 is attached and supported. Platform 40 includes a plurality of slots 44 which receive corresponding tabs 46 in latch-rail 42. When tabs 46 are inserted into slots 44, the lower edge of latch-rail 42 will sit flush on platform 40, and the proximal and distal ends of latch-rail 42 will be aligned with the proximal and distal ends of platform 40. Tabs 46 are then spot-welded or otherwise affixed to platform 40 so as to secure latch-rail 42 to support bracket 26.

For ease of construction, and to make latch-rail 42 lightweight but sturdy, the underside of latch-rail 42 is formed as an open channel. However, latch-rail 42 could alternatively be of a solid structure. Referring also to FIG. 3, latch-rail 42 includes finger-like projections 48*a*, 48*b* extending from its proximal end. These projections are semi-circular in shape, but could be of other shapes if desired. Located at the distal end of latch-rail 42 is a nosepiece 50 having a tab 52 at its end.

Support bracket 26 as well as latch-rail 42 are typically fabricated from materials such as steel, aluminum or the like, which are rigid and capable of supporting the weight of the furniture component to be attached.

For additional strength, one or more reinforcing ribs 54 can also be stamped into support bracket 26 if desired.

Figure 2B:
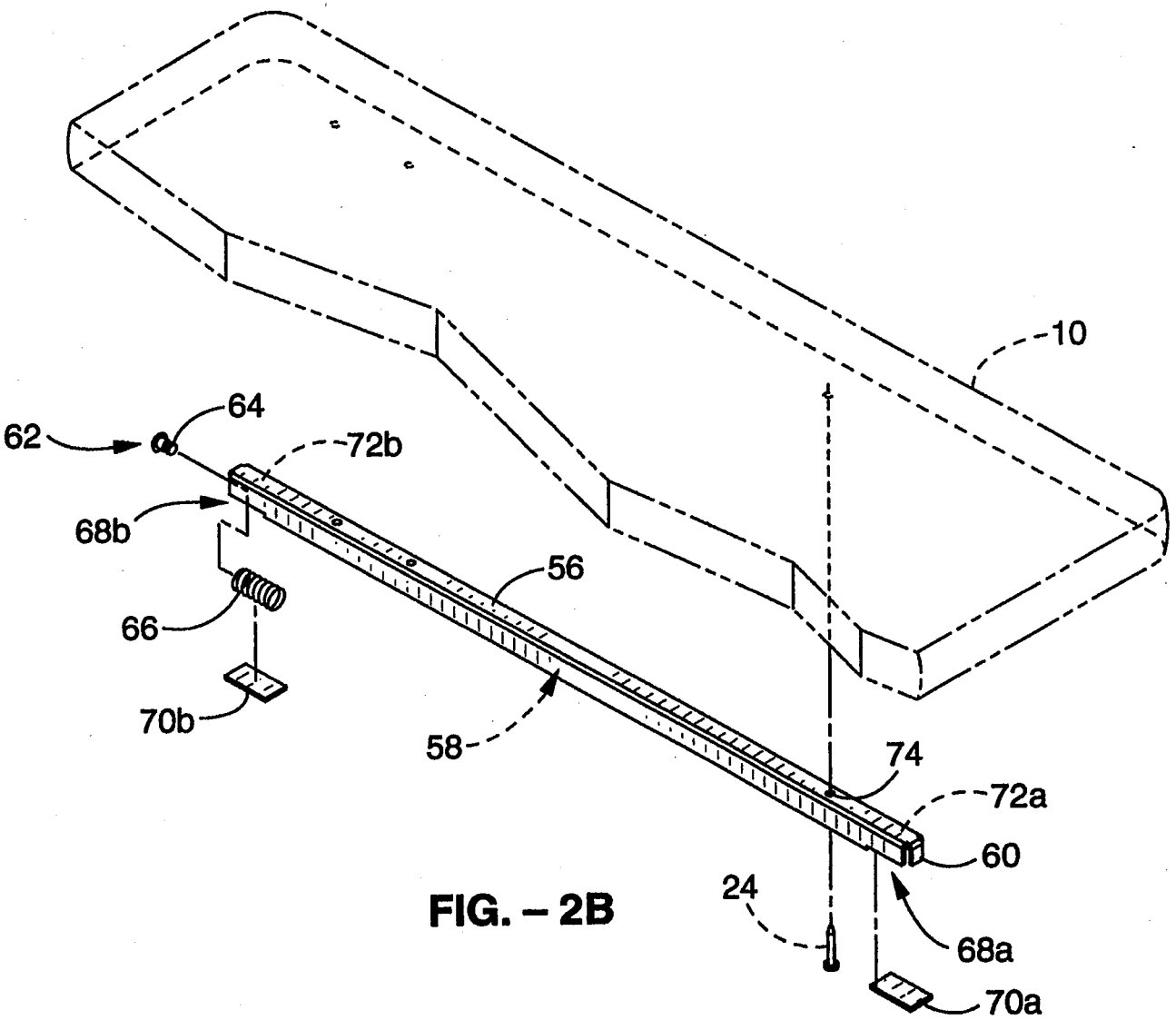
FIG. 2B is an exploded view of catch-track subassembly of the present invention, and a work surface depicted in phantom.

Referring also to FIG. 2B, catch-track subassembly 20 generally comprises a catch-track 56, which is an elongated member having a channel 58 extending from its proximal end to its distal end, with the channel 58 opening downward. Channel 58 is sized so as to permit insertion of latch-rail 42. Each end of catch-track 56 includes a tab 60 which closes off channel 58. At the distal end of catch-track 56, a hole (not shown) is provided in the tab for insertion of a spring retainer 62. Spring retainer 62 is a rivet or the like having a bulbous end 64. A spring 66 is positioned within channel 58 at the distal end of catch-track 56 and inserted over the spring retainer 62. Where a rivet is used for spring retainer 62, after installation the bulbous end 64 will have a diameter slightly larger than the inner diameter of spring 66, thereby providing a secure fit.

The lower edge of the sidewalls of catch-track 56 at the proximal and distal ends include notches 68*a*, 68*b* wherein retainer plates 70*a*, 70*b* are fitted, respectively. Retainer plates 70*a*, 70*b* are preferably welded or otherwise securely attached to catch-track 56. In this manner, a first receptacle 72*a* is formed at the proximal end of catch-track 56 into which the finger-like tabs 48*a*, 48*b* at the proximal end of latch-rail 42 can extend. Further, a second receptacle 72*b* is formed at the distal end of catch-track 56 to contain spring 66 and into which nosepiece 50 at the distal end of latch-rail 42 can extend. Catch-track 56 is secured to a furniture component using screws 24 or the like which extend through channel 58 by means of holes 74 and into the component to which the subassembly is attached. Other conventional means of attachment could be alternatively employed. Preferably, catch-track 56 is formed from a rigid material such as aluminum, steel or the like. In this manner, catch-track 56 can be cut from sheet metal, and scored and bent into the configuration shown.

Figure 4:
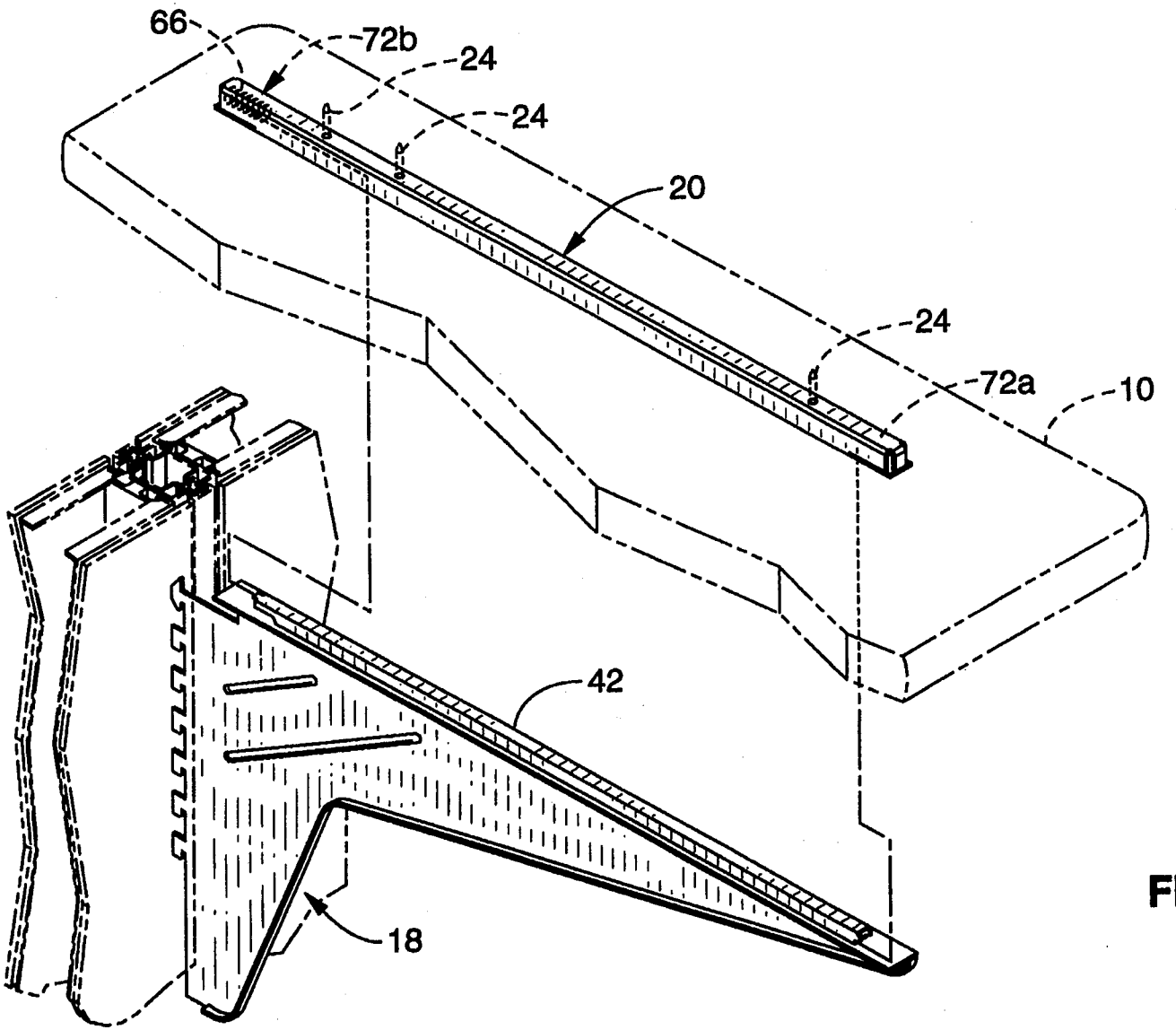
FIG. 4 is a diagrammatic view showing a work surface depicted in phantom being positioned for attachment to the support bracket and latch-rail subassembly of the present invention.
Figure 5:
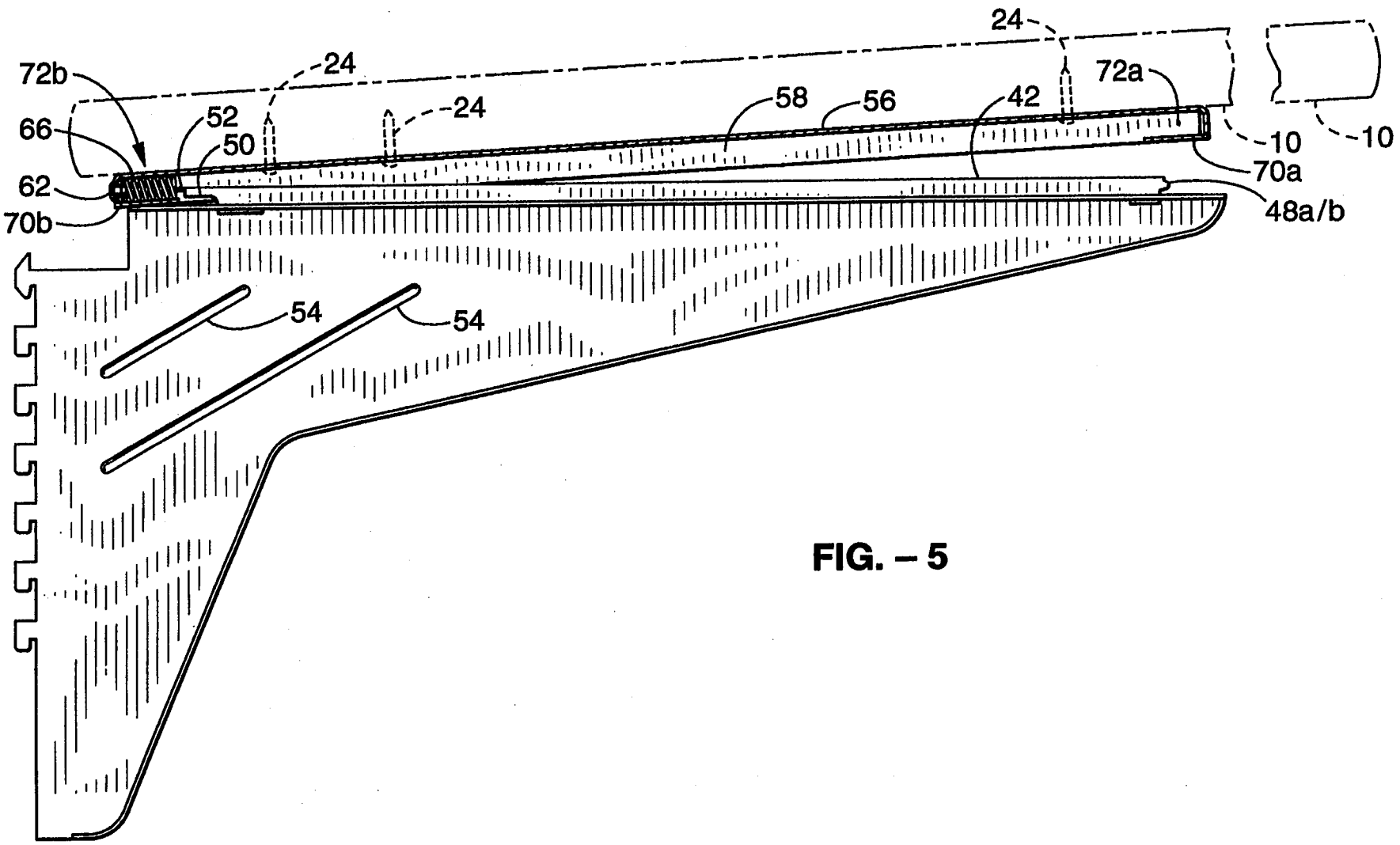
FIG. 5 is an exploded view showing the catch-track subassembly of FIG. 2B in relation to the component support subassembly of FIG. 2A.

Referring also to FIG. 4 and FIG. 5, a furniture component 10 to which catch-track subassembly 20 is attached is installed by placing the distal end of catch-track subassembly 20 over the distal end of latch-rail 42 at a slight vertical angle. Component 10 is then lowered into a horizontal position while at the same time pulling forward on the component. In this manner, nosepiece 50 will slide into the receptacle 72*b* at the distal end of catch-track 56. Tab 52 will then extend into spring 66 and nosepiece 50 will engage and compress spring 66 when component 10 is pulled forward. To prevent the wall structure 12 from moving forward, at the same time the installer can place his or her hand against the face of the wall structure. When latch-rail 42 is positioned within channel 58, the component is released. The component is then drawn rearward toward the distal end of component support subassembly 18 under the force of spring 66 which extends to a semi-uncompressed state. At that point, the finger-like tabs 48*a*, 48*b* on the proximal end of latch-rail 24 will extend into receptacle 72*a* at the proximal end of catch-track 56, thereby latching catch-track 56 and latch-rail 24 together in a fixed position with their proximal and distal ends being generally aligned. Note also, that nosepiece 50 on the distal end of latch-rail 24 will extend into the receptacle 72*b* at the distal end of catch-track 56. In this manner, vertical movement of catch-track 56 in relation to latch-rail 24 at their proximal and distal ends is prevented.

The furniture component can then be removed by pulling forward until the proximal end of latch-rail 24 clears retainer plate 70*a*, and reversing the foregoing procedure. As can be seen, the combination of catch-track 56 and latch-rail 24 provides a spring-loaded latching mechanism which can be coupled and uncoupled when desired. The mechanism can be uncoupled by applying opposing axial forces to catch-track 56 and latch-rail 24 along their longitudinal axis. Spring 66 is compressed and the proximal end of latch-rail 24 is retracted from the receptacle 72*a* at the proximal end of catch-track 56. When tabs 48*a*, 48*b* clear retainer plate 70*a*, opposing forces in a generally perpendicular direction in relation to the longitudinal axis can be applied to remove the proximal end of latch-rail 24 from the proximal end of channel 58.

Accordingly, it will be seen that this invention provides for secure automatic latching of a furniture component to a support bracket. Further the invention allows an installer to apply forces away from the panel structure (toward the installer) during installation in a manner which will not cause the wall panel to move, thereby improving the installation process. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An apparatus for detachably coupling a component to a support structure, comprising:

(a) a bracket, said bracket having proximal and distal ends;

(b) a rail member, said rail member fixed coupled to said bracket, said rail member having proximal and distal ends;

(c) a track member, said track member having proximal and distal ends, said track member including channel means for receiving said rail member; and (d) spring means, coupled to said distal end of said track member, for detachably coupling said proximal end of said rail member to said proximal end of said track member.

2. An apparatus as recited in claim 1, further comprising bracket coupling means for coupling said bracket to a support structure, said bracket coupling means extending from said distal end of said bracket.

3. An apparatus as recited in claim 2, wherein said bracket coupling means comprises a plurality of rearwardly and downwardly projecting hook means for engaging slots in said support structure.

4. An apparatus as recited in claim 1, further comprising component coupling means for coupling said track member to a component.

5. An apparatus as recited in claim 4, wherein said component coupling means comprises:

(a) a plurality of holes extending through said channel means; and (b) a plurality of fastener means for extending through said holes and into said component.

6. An apparatus as recited in claim 1, further comprising first receptacle means for receiving said proximal end of said rail member, said first receptacle means positioned at said proximal end of said track member.

7. An apparatus as recited in claim 6, further comprising second receptacle means for receiving said distal end of said rail member, said second receptacle means positioned at said distal end of said track member.

8. An apparatus for detachably coupling a furniture component to a wall structure, comprising:

(a) a bracket, said bracket having proximal and distal ends;

(b) a rail member, said rail member fixed coupled to said bracket, said rail member having proximal and distal ends;

(c) a track member, said track member having proximal and distal ends, said track member including channel means for receiving said rail member;

(d) first receptacle means positioned at said proximal end of said track member, for receiving said proximal end of said rail member:

(e) second receptacle means, positioned at said distal end of said track member, for receiving said distal end of said rail member; and (f) spring means, disposed within said second receptacle means, for latching said proximal end of said rail member to said first receptacle means.

9. An apparatus as recited in claim 8, further comprising bracket coupling means for coupling said bracket to a wall structure, said bracket coupling means extending form said distal end of said bracket.

10. An apparatus as recited in claim 9, wherein said bracket coupling means comprises a plurality of rearwardly and downwardly projecting hook means for engaging slots in said wall structure.

11. An apparatus as recited in claim 8, further comprising component coupling means for coupling said track member to a furniture component.

12. An apparatus as recited in claim 11, wherein said component coupling means comprises:

(a) a plurality of holes extending through said channel means; and (b) a plurality of fastener means for extending through said holes and into said furniture component.

13. An apparatus for detachably coupling a modular furniture component to a wall structure having a slotted vertical component support rail, comprising:

(a) a component support bracket, said component support bracket including an upper longitudinal edge, said component support bracket having proximal and distal ends.

(b) an elongated latch-rail, said latch-rail fixedly coupled to said support bracket along said upper longitudinal edge, said latch-rail having proximal and distal ends aligned with said proximal and distal ends of said support bracket;

(c) an elongated catch-track, said catch-track having proximal and distal ends, said catch-track including channel means for receiving said latch-rail, said channel means extending between said proximal and distal ends of said catch-track;

(d) said catch track including first receptacle means, positioned at said proximal end of said catch-track, for receiving said proximal end of said latch-rail;

(e) said catch-track including second receptacle means, positioned at said distal end of said catch-track, for receiving said distal end of said latch-rail; and (f) a spring, said spring disposed within said second receptacle and coupled to said distal end of said catch-track;

(g) said proximal end of said latch-rail being removable from said first receptacle by compression of said spring, and said proximal end of said latch-rail being coupled to said first receptacle by extension of said spring.

14. An apparatus as recited in claim 13, further comprising bracket coupling means for coupling said component support bracket to a component support rail, said bracket coupling means extending form said distal end of said component support bracket.

15. An apparatus as recited in claim 14, wherein said bracket coupling means comprises a plurality of rearwardly and downwardly projecting hook means for engaging slots in said component support rail.

16. An apparatus as recited in claim 15, further comprising component coupling means for coupling said catch-track to a modular furniture component.

17. An apparatus as recited in claim 16, wherein said component coupling means comprises:

(a) a plurality of holes extending through said channel means; and (b) a plurality of fastener means for extending through said holes and into said modular furniture component.

* * * * *